US006421021B1

(12) United States Patent
Rupp et al.

(10) Patent No.: US 6,421,021 B1
(45) Date of Patent: Jul. 16, 2002

(54) ACTIVE ARRAY LENS ANTENNA USING CTS SPACE FEED FOR REDUCED ANTENNA DEPTH

(75) Inventors: Frederick C. Rupp, Redondo Beach; Clifton Quan, Arcadia; Patrick J. Fitzgerald, Northridge; Steven G. Buczek, Brea, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/836,896

(22) Filed: Apr. 17, 2001

(51) Int. Cl.[7] ..... H01Q 19/06; H01Q 13/10
(52) U.S. Cl. ..... 343/753; 343/770; 343/772
(58) Field of Search ..... 343/753, 754, 343/770, 771, 772, 776, 909

(56) References Cited

U.S. PATENT DOCUMENTS

| | | | | |
|---|---|---|---|---|
| 5,266,961 | A | 11/1993 | Milroy | 343/772 |
| 5,349,363 | A | 9/1994 | Milroy | 343/772 |
| 5,361,076 | A | 11/1994 | Milroy | 343/772 |
| 5,380,386 | A | 1/1995 | Oldham et al. | 156/150 |
| 5,398,010 | A | 3/1995 | Klebe | 333/239 |
| 5,412,394 | A | 5/1995 | Milroy | 343/785 |
| 5,469,165 | A | 11/1995 | Milroy | 342/13 |
| 5,483,248 | A | 1/1996 | Milroy | 343/785 |
| 5,543,815 | A | 8/1996 | Wu et al. | 343/909 |
| 5,583,524 | A | 12/1996 | Milroy | 343/772 |
| 5,607,631 | A | 3/1997 | Wolfson et al. | 264/61 |
| 5,719,975 | A | 2/1998 | Wolfson et al. | 385/48 |
| 5,771,567 | A | 6/1998 | Pierce et al. | 29/600 |
| 5,781,087 | A | 7/1998 | Milroy et al. | 333/257 |
| 5,835,068 | A | 11/1998 | Paul et al. | 343/757 |
| 5,905,472 | A | 5/1999 | Wolfson et al. | 343/772 |
| 5,926,077 | A | 7/1999 | Milroy | 333/125 |
| 5,995,055 | A | 11/1999 | Milroy | 343/772 |
| 6,075,494 | A | 6/2000 | Milroy | 343/776 |
| 6,101,705 | A | 8/2000 | Wolfson et al. | 29/600 |
| 6,127,984 | A | 10/2000 | Klebe et al. | 343/770 |

*Primary Examiner*—Don Wong
*Assistant Examiner*—Hoang Nguyen
(74) *Attorney, Agent, or Firm*—Leonard A. Alkov; Glenn H. Lenzen, Jr.

(57) ABSTRACT

A space-fed active array lens antenna system has an active array lens with a first array of radiating elements defining a front antenna aperture which transmits and receives RF energy from free space, a second array of radiating elements defining a rear antenna aperture which transmits and receives RF energy from a feed aperture, and an array of transmit/receive (T/R) modules sandwiched between the front aperture and rear aperture. The T/R modules include a phase control circuit and an amplitude control circuit which provide phase and amplitude control for RF signals passing through the modules. The feed aperture includes a wide band CTS aperture which produces a plane wave in the near field.

20 Claims, 5 Drawing Sheets

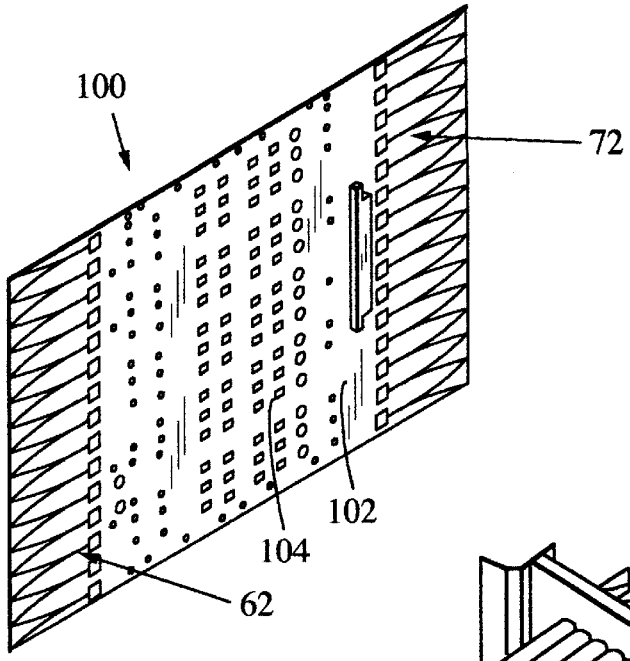
Fig. 4
Fig. 5
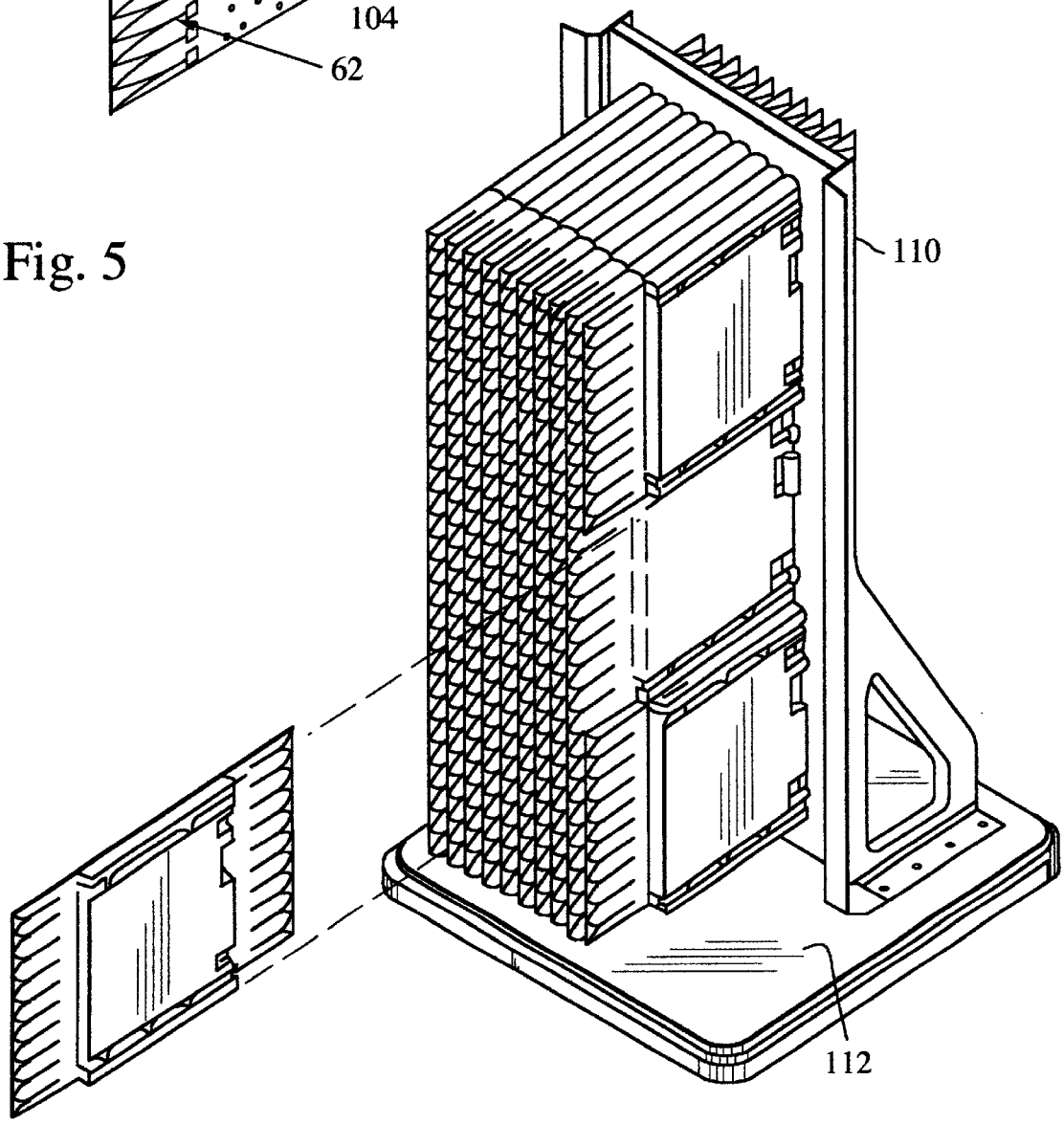

ACTIVE ARRAY LENS ANTENNA USING CTS SPACE FEED FOR REDUCED ANTENNA DEPTH

This invention was made with Government support under a Government contract. The Government has certain rights in this invention.

TECHNICAL FIELD OF THE INVENTION

This invention relates to active array antennas, and more particularly to a lens antenna fed by a wide band continuous transverse stub (CTS) aperture, providing reduced antenna depth.

BACKGROUND OF THE INVENTION

In a typical active array antenna, there are many, and even for some applications, thousands, of hard RF connections between the T/R modules and the RF feed network. Examples of these hard connections include cable interconnects, precision "blind mate" connectors, and gold ribbon/wire bonds.

Another type of phase array antenna is the space-fed antenna array, which use space feeds instead of hard connections. However, the known space-fed phased arrays suffer spillover and reflection losses, do not offer as much pattern control for low-sidelobe radiation as arrays employing hard connections, and are bulky. R. J. Mailloux, *Phased Array Antenna Handbook*, Artech House 1994, pg. 315; Z. Popovic', "T/R Lens Amplifier Antenna Arrays for X-band and Ka-band", Applied Microwave & Wireless Magazine, 1998; C. J. Sletten, Reflection and Lens Antennas: Analysis and Design Using Personal Computers, Artech House 1988. This is because typical space-fed phased arrays have only phase control and not amplitude control. Moreover, the focal length of space-fed antenna systems is typically on the order of several feet.

SUMMARY OF THE INVENTION

The invention is an active array lens antenna fed by a wide band CTS aperture. The active lens antenna includes T/R modules having both amplitude and phase control. The innovation of a wide band CTS aperture to feed the lens results in a reduction of the focal length distance from several feet to less than an inch. Thus an antenna in accordance with an aspect of this invention can be less bulky than typical space-fed phase arrays. The use of the CTS feed has reduced the array volume to a greater degree than what has been accomplished with previous space feed approaches.

In accordance with a further aspect of the invention, the need for thousand of hard interconnects between the RF manifold and T/R modules has been eliminated, while allowing the active antenna to operate across a wide frequency band. The reduction of the focal length distance by using the CTS aperture allows the overall antenna depth to be comparable to conventional active arrays. The T/R modules within the array provide the phase and amplitude control needed to realized low-sidelobe radiation for the antenna. The use of T/R modules with both amplitude and phase control provides the means to compensate for errors due to "spillover". Thus, in accordance with a further aspect of the invention, the lens antenna provides improved sidelobe control.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 is an simplified diagrammatic view of a PCB strip carrying the radiators and transmit/receive module components of the system of FIG. 1.

FIG. 5 illustrates an exterior support structure including a sheer panel and plate holding the PCB strips together to form the active lens of the system of FIG. 1.

DETAILED DESCRIPTION OF THE PREFERRED EMBODIMENTS

Figure 1:
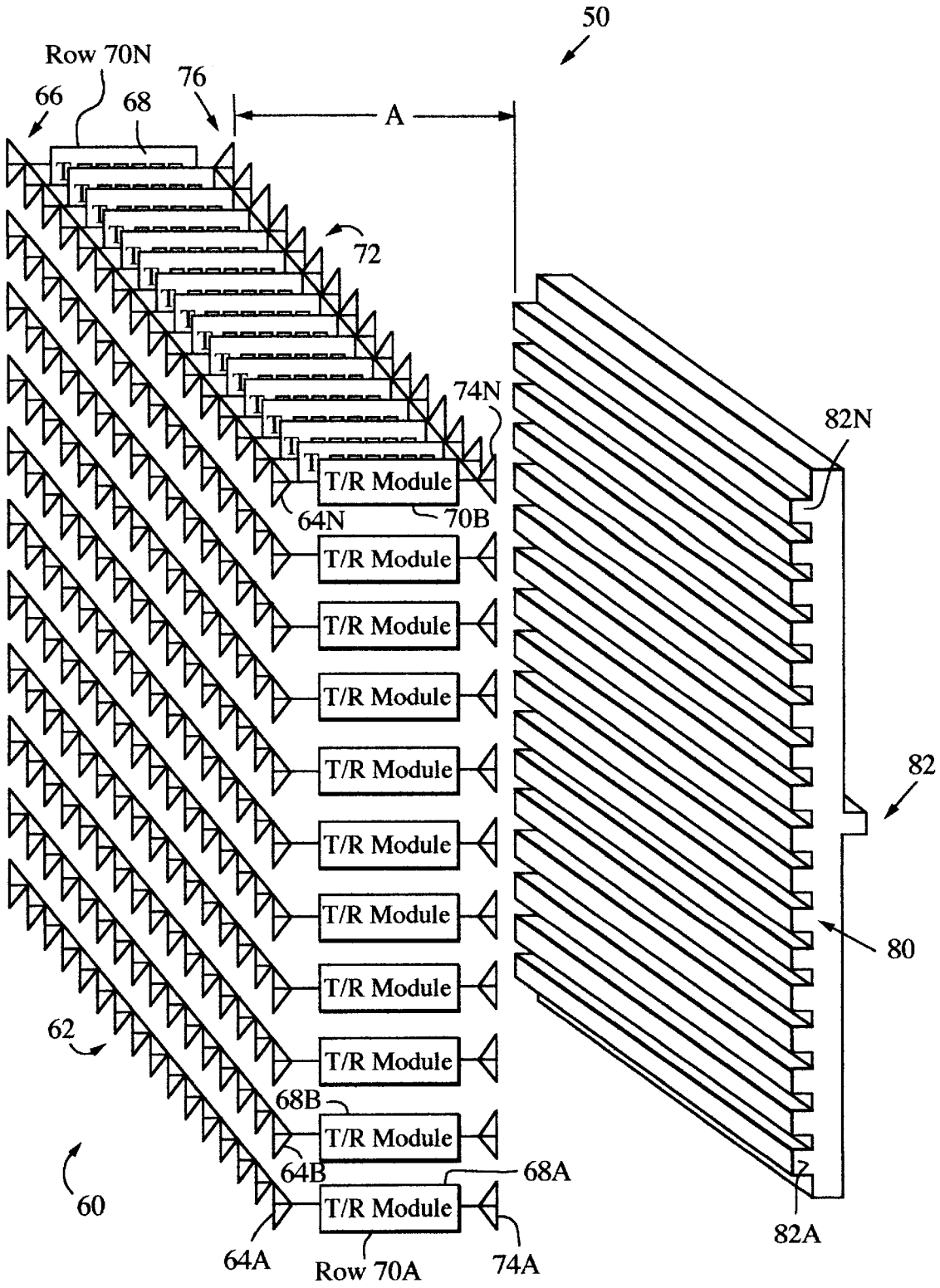
FIG. 1 illustrates a space-fed active array lens antenna embodying the invention.

FIG. 1 is a diagrammatic view illustrating an exemplary embodiment of an active array lens antenna system 50 in accordance with the invention. The system includes an active array lens 60 comprising a two-dimensional array of radiating elements 62 arranged in rows 64A–64N to define a front antenna aperture 66. The radiating elements are each connected to an input/output (I/O) port of a corresponding transmit/receive (T/R) module 68, which are also arranged in rows 70A–70N. The other I/O port of the T/R module 68 is connected to a corresponding two-dimensional array of radiating elements 72, which are arranged in rows 74A–74N to define a rear antenna aperture 76.

The active array lens is fed by a wide band CTS aperture 80 as illustrated in FIG. 1. The CTS aperture 80 has an RF input 82, typically provided by a coaxial to rectangular waveguide adapter. The waveguide cross-sectional configuration is designed to physically mate to the CTS aperture 80.

Figure 2:
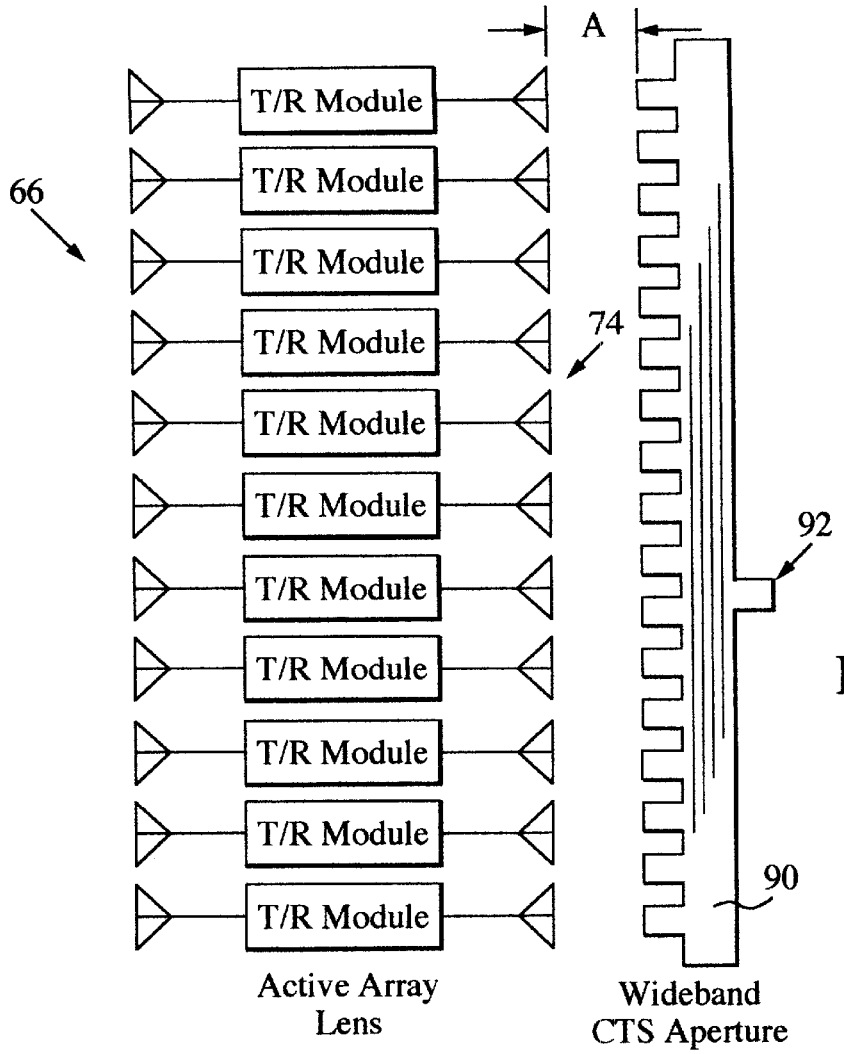
FIG. 2 is an end view of the antenna of FIG. 1.
Figure 3:
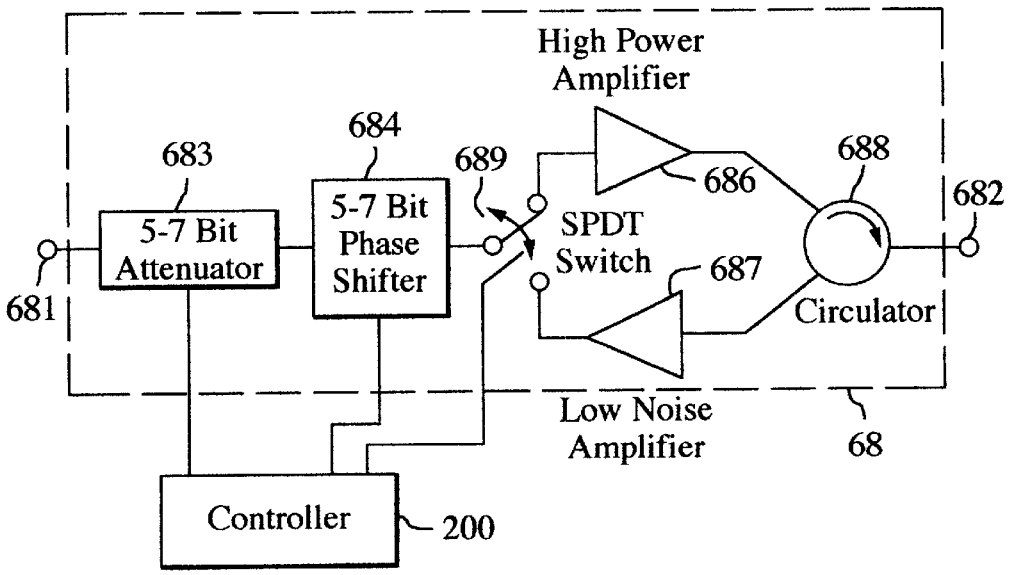
FIG. 3 is a simplified block diagram of functions of an exemplary T/R module employed in the antenna of FIG. 1.
Figure 6:
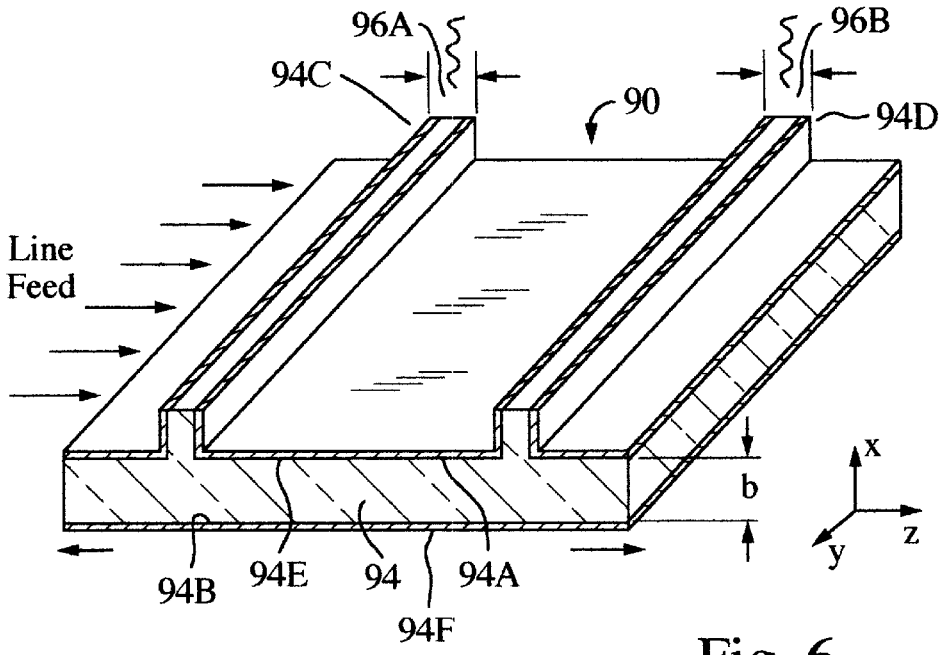
FIG. 6 is a schematic cross-sectional depiction of a portion of a series fed CTS aperture

The active array lens 60 includes T/R modules 68A–68N that are sandwiched between two radiating apertures, the front aperture 66 and the rear aperture 76. The front aperture 66 is used to transmit and receive RF signals to and from free space. The rear aperture 76 is used to transmit and receive RF signals to and from the RF feed which in this embodiment is the wide band CTS aperture 80, as further illustrated in the end view of FIG. 2. Because the CTS aperture produces a plane wave in the near field, the CTS aperture 80 is able to feed the lens 60 at reduced focal length distance, in this embodiment of less than 0.55 inches for a frequency range of operation of 6 Ghz to 18 Ghz, as compared with from several feet with conventional waveguide horn feeds. The reduction of the focal length distance by using the CTS aperture 80 allows the overall antenna depth to be comparable to conventional active arrays with RF feed network with hard RF connections. The T/R modules 68 used within the lens provide both amplitude and phase control for beam steering and sidelobe control. The use of T/R modules with both amplitude and phase control also provides the means to compensate for errors due to "spill over". Thus this lens antenna provides better sidelobe control than what has been achieved with known space fed phase scan array antennas which have only phase control but not amplitude. FIG. 3 is a simplified schematic diagram depicting an exemplary T/R module, say module 68A. The module includes I/O ports 681, 682, with port 681 being connected to a feed element 74A and port 682 being connected to a radiating element 64A. The module further includes an amplitude control circuit 683, in this example a 5 to 7 bit attenuator, and a phase control circuit 684, in this example a 5 to 7 bit phase shifter. A single-pole-double-throw (SPDT) switch 689 selects either a transmit channel through a high power amplifier 686 on transmit or a low noise amplifier on receive to the phase control circuit. A three-port circulator 688 couples the output of the high power amplifier to I/O port 682, and couples the port 682 to the low noise amplifier 687. The amplitude control circuit, 683, the phase control circuit 684 and the switch 689 are controlled by the array controller 200.

With the elimination of the hard interconnects between the RF manifold and T/R modules, the lens can be packaged such that the radiators, circulator and MMIC devices (making up the T/R module functions) are fabricated on a set of printed circuit board (PCB) strips, with the associated radiators, as shown in FIG. 3. FIG. 4 illustrates how the radiators, circulator and MMIC devices can be integrated on a PCB strip 100. Each strip contains multiple T/R module channels. The multi-channel strips include a single printed circuit with integrated printed radiators, circulators, MMIC devices, making up multiple channels of T/R module functions, and constituting a subarray assembly within the lens aperture. The strips include a low profile DC/signal connector 102, and mounting locations for mounting the T/R device components (not shown). An exterior support structure including a sheer panel 110 and plate 112 holds these multi-channel T/R strips together to form the active lens, as illustrated in FIG. 5. The sheer panel is added to the one face of the lens to hold the multi-channel T/R strips together as a active lens assembly and ensure alignment of the radiating aperture. The panel is slotted to allow the printed radiator to protrude through it without short circuiting. Provisions are designed into this panel to route external DC, signal and cooling to each strip. This panel can be mounted to either the front aperture of the lens or the back aperture of the lens to allow access and removal of the active strips in the back of the antenna or front respectively.

In one exemplary embodiment, the lens uses a wide band printed flare notched radiator with a microstrip to slotline balun.

Continuous transverse stub (CTS) apertures are known in the art. For example, U.S. Pat. Nos. 5,266,961; 5,349,363; 5,412,394; and 6,075,494 describe several CTS apertures. As shown in FIG. 5, one CTS aperture 90 includes a dielectric structure having two parallel broad surfaces 94A, 94B with a plurality of raised integral stub portions including stub portions 94C, 94D extending transversely across one broad surface 94A. The exterior of the structure 94 is coated with electrically conductive layers 94E, 94F, resulting in a parallel plate waveguide structure having continuous transverse stub elements disposed adjacent one plate. Radiating elements including elements 96A, 96B are formed by opening the stub elements to free space, e.g. by omitting the coating from the open ends of the transverse stubs. Incident parallel waveguide modes, launched via a primary line feed of arbitrary configuration, have associated with them longitudinal electric current components interrupted by the presence of the continuous stubs, thereby exciting a longitudinal z-directed displacement current across the stub/parallel plate interface. This induced displacement current in turn excites equivalent EM waves travelling in the stub in the x-direction to its terminus which radiate into free space. CTS arrays can be fabricated for operation at frequencies as high as 94 GHz or even higher.

Figure 7:
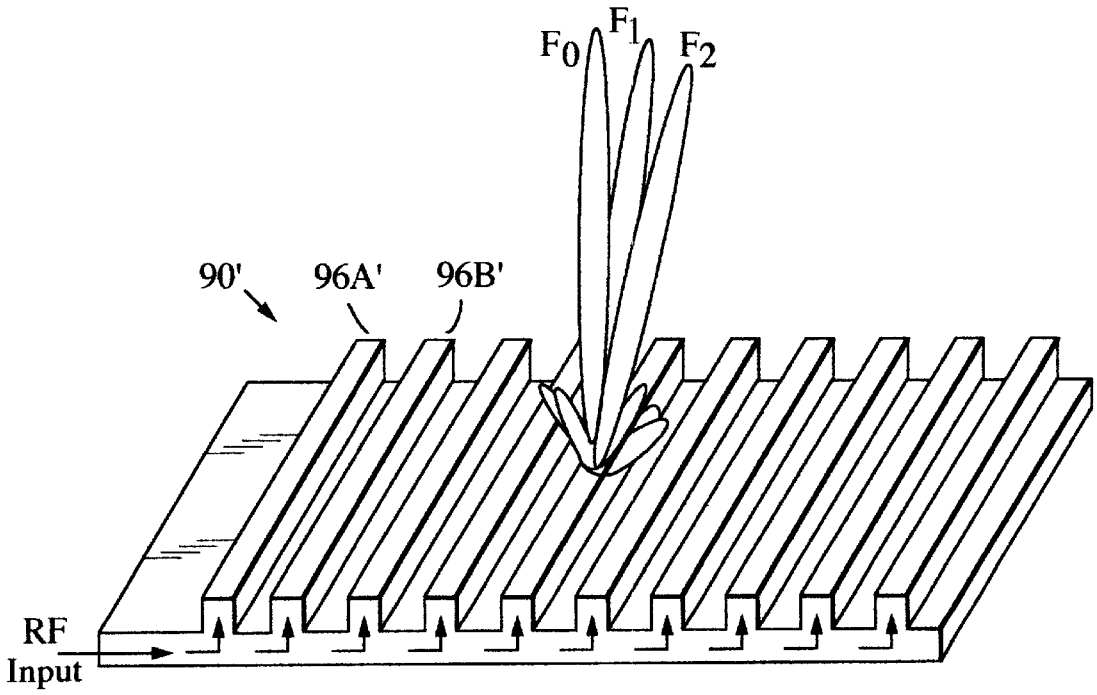
FIG. 7 is a simplified side isometric view of a series fed CTS aperture.

Typically, the CTS elements within a CTS aperture are series fed with the parallel plate waveguide structure, as illustrated in FIG. 7. The distances for RF signals to travel from the input to each of the CTS radiating elements 96A, 96B . . . are not equal. For this type of series fed aperture, frequency variations of the input signals will in turn vary the output phase of each CTS radiating element at different rates, resulting in frequency scanning. For this reason, a series fed CTS array is typically used for narrow band operations to avoid frequency scanning.

The system 50 (FIG. 1) employs a wide band CTS aperture 80, which in this exemplary embodiment operates across a 6 Ghz to 18 Ghz band width, although for a series fed aperture could be employed, if narrow band operation meets the needs of a given application. The aperture 60 includes 16 line elements 82A–82N each 10.3 inches in length spaced at 0.4 inch thus providing a 6.4 inch by 10.3 inch active area to feed the active lens of comparable size.

Figure 8:
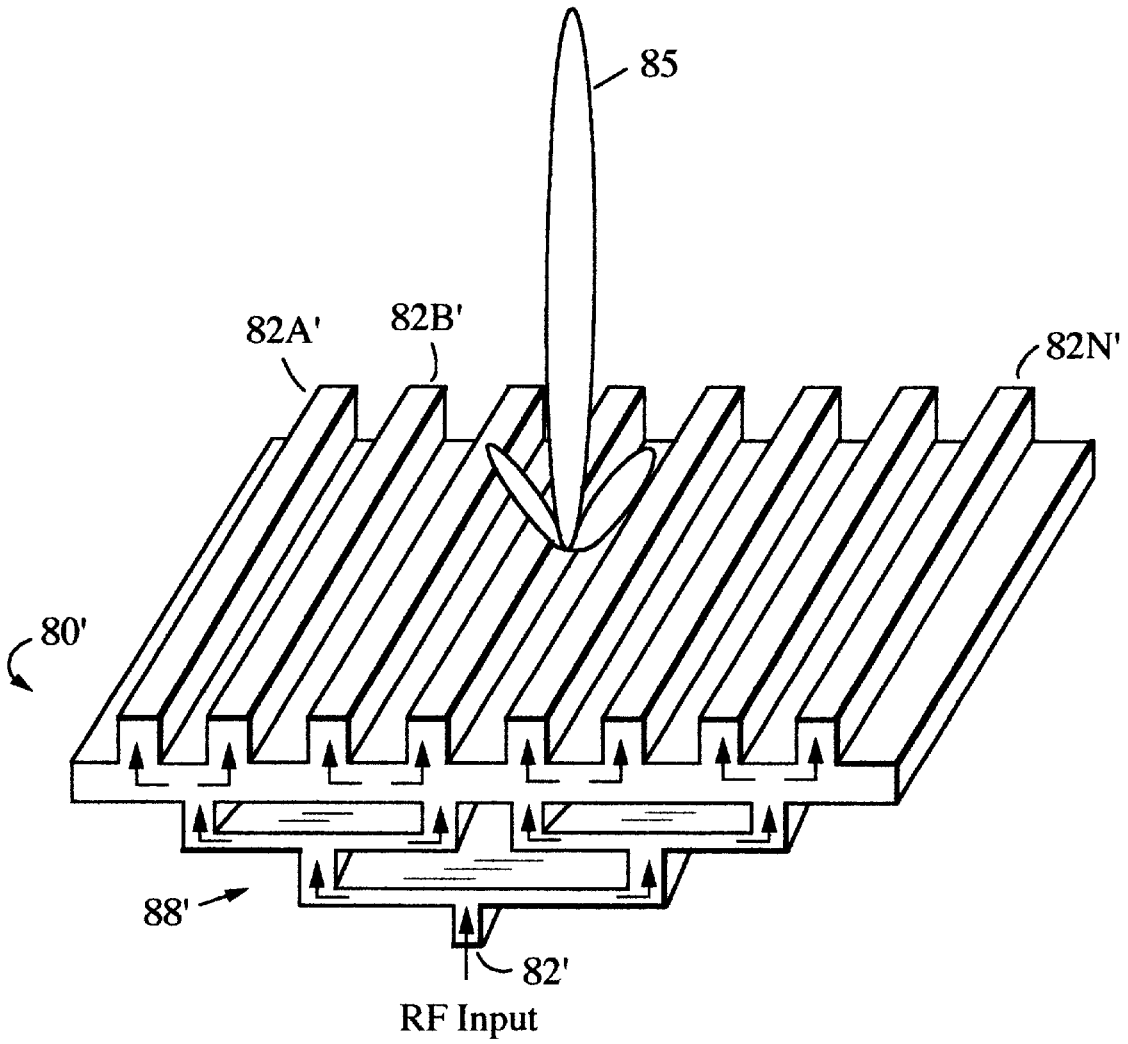
FIG. 8 is a simplified side isometric view of a parallel fed CTS aperture with a corporate parallel plate corporate feed.

The architecture of the wide band CTS aperture 80 includes an internal corporate RF manifold comprising a dielectric filled parallel plate waveguide as the transmission line and radiation media. A wideband CTS aperture is achieved by feeding in parallel the CTS elements using a corporate parallel plate waveguide feed. An exemplary RF manifold structure 88' is illustrated in FIG. 8. For simplicity, the CTS aperture 80' in FIG. 8 has 8 radiating elements; the manifold structure 88' is readily extended to 16 elements by including a further manifold stage. The distances for the RF signals to travel from the input to each of the CTS radiating elements 82A'–88N' are equal. As the frequency of operations changes, the output phase of each CTS radiating element changes at the same rate, and thus the beam 85 remains in a fixed position. An ultra-wideband corporate feed architecture suitable for use in the aperture 80 is described in U.S. Pat. No. 6,075,494, the entire contents of which are incorporated herein by this reference.

A primary advantage of the CTS aperture is its simple design. The antenna includes a dielectric, e.g. a plastic such as rexolite or polypropylene, that is machined or extruded to the shape generally illustrated in FIG. 8. This is then metal plated to form the final CTS antenna. Thus, the CTS lends itself to high volume plastic and extrusion and metal plating processes (common in automobile applications, for example), thereby enabling low cost production.

A larger CTS aperture can feed a larger corresponding active lens. With phase and amplitude control provided by the T/R module, it has been determined that the spacing of the radiating elements or element on the active lens does not need to match or correspond to the spacing on the CTS aperture feed respectively. Thus the invention of a CTS space fed active array lens eliminates the need for thousand of hard interconnects between the RF manifold and T/R modules while allowing the active antenna to operate across a wide frequency band and without increase of array depth.

One aspect of this invention enables the reduction of the focal length of the space-fed phased array antenna, e.g. in an exemplary embodiment and for an exemplary frequency range of operation, from several feet for typical space-fed phase arrays to less than an inch. Thus a phased array in accordance with an aspect of this invention can be less bulky than typical space-fed phase arrays. The use of a CTS feed has reduced the array volume to a greater degree than what has been accomplished with current space feed approaches.

It is understood that the above-described embodiments are merely illustrative of the possible specific embodiments which may represent principles of the present invention.

Other arrangements may readily be devised in accordance with these principles by those skilled in the art without departing from the scope and spirit of the invention.

What is claimed is:

1. A space-fed active array lens antenna system, comprising:

an active array lens comprising a first array of radiating elements defining a front antenna aperture which transmits and receives RF energy to and from free space, a second array of radiating elements defining a rear antenna aperture which transmits and receives RF energy to and from a feed aperture, and an array of transmit/receive (T/R) modules coupled between the front aperture and rear apertures;

wherein the T/R modules include a phase control circuit and an amplitude control circuit which provide phase and amplitude control for RF signals passing between the front aperture and the rear aperture; and wherein the feed aperture comprises a continuous transverse stub (CTS) aperture which produces a plane wave in the near field.

2. The system of claim 1, wherein the array has a frequency range of operation of between 6 Ghz and 18 Ghz.

3. The system of claim 1, wherein the first array of radiating elements is an array of flared notch radiating elements.

4. The system of claim 3, wherein the second array of radiating elements is an array of flared notch radiating elements.

5. The system of claim 4 wherein the radiating elements are arranged in rows and columns, and wherein the radiating elements for a group of radiating elements of the first array and the second array in a column are fabricated on a single printed circuit board.

6. The system of claim 1 wherein the second array of said radiating elements is positioned in the near field of the feed aperture.

7. The system of claim 1 wherein the CTS aperture is a wide band aperture capable of operation over a wide frequency band without significant scanning of a beam in near field over the frequency band of operation.

8. The system of claim 7 wherein the CTS aperture includes a feed architecture comprising a corporate parallel plate feed structure.

9. The system of claim 7 wherein the second array of said radiating elements is positioned in the near field of the feed aperture, at a gap spacing of less than one inch, and wherein the wide band aperture is for operation over a frequency range of 6 Ghz to 18 Ghz.

10. The system of claim 1 wherein the CTS aperture comprises a plurality of spaced continuous stub radiating elements, and wherein a spacing of the radiating elements of the second array does not match a spacing of the continuous stub radiating elements.

11. The system of claim 1 wherein the feeding of RF signals between the second array of radiating elements and the feed aperture is free of hard electrical interconnects.

12. The system of claim 1 wherein the CTS aperture is a wide band aperture capable of operation over a wide frequency band without significant scanning of a beam in near field over the frequency band of operation.

13. A space-fed active array lens antenna system, comprising:

a wide band feed continuous transverse stub (CTS) feed aperture which produces a plane wave in the near field; and an active array lens comprising:

a first array of radiating elements defining a front antenna aperture which transmits and receives RF energy to and from free space, a second array of radiating elements defining a rear antenna aperture which transmits and receives RF energy to and from said feed aperture, the second array positioned in the near field of the feed aperture, and an array of transmit/receive (T/R) modules coupled between the front aperture and rear aperture, said T/R modules including a phase control circuit and an amplitude control circuit which provide phase and amplitude control for RF signals passing between the front aperture and the rear aperture.

14. The system of claim 13, wherein the first array of radiating elements is an array of flared notch radiating elements.

15. The system of claim 14, wherein the second array of radiating elements is an array of flared notch radiating elements.

16. The system of claim 15 wherein the radiating elements are arranged in rows and columns, and wherein the radiating elements for a group of radiating elements of the first array and the second array in a column are fabricated on a single printed circuit board.

17. The system of claim 13 wherein the CTS aperture includes a feed architecture comprising a corporate parallel plate feed structure.

18. The system of claim 13 wherein the second array of said radiating elements is positioned at a gap spacing of less than one inch from the CTS aperture, and wherein the wide band aperture is for operation over a frequency range of 6 Ghz to 18 Ghz.

19. The system of claim 13 wherein the CTS aperture comprises a plurality of spaced continuous stub radiating elements, and wherein a spacing of the radiating elements of the second array does not match a spacing of the continuous stub radiating elements.

20. The system of claim 13 wherein the feeding of RF signals between the second array of radiating elements and the feed aperture is free of hard electrical interconnects.

* * * * *